US010595650B2

(12) United States Patent
Pallai

(10) Patent No.: US 10,595,650 B2
(45) Date of Patent: Mar. 24, 2020

(54) HIDDEN LIGHTING FOR A DISPLAY SPACE

(71) Applicant: EKLIPSE LUMINAIRE ARCHITECTURAL INC., Montreal (CA)

(72) Inventor: Andre Pallai, Montreal (CA)

(73) Assignee: EKLIPSE LUMINAIRE ARCHITECTURAL INC., Montréal (CA)

( * ) Notice: Subject to any disclaimer, the term of this patent is extended or adjusted under 35 U.S.C. 154(b) by 0 days.

(21) Appl. No.: 16/087,849

(22) PCT Filed: Mar. 24, 2017

(86) PCT No.: PCT/CA2017/050377
§ 371 (c)(1),
(2) Date: Sep. 24, 2018

(87) PCT Pub. No.: WO2017/161462
PCT Pub. Date: Sep. 28, 2017

(65) Prior Publication Data

US 2019/0104868 A1 Apr. 11, 2019

Related U.S. Application Data

(60) Provisional application No. 62/312,847, filed on Mar. 24, 2016.

(51) Int. Cl.
*A47F 11/10* (2006.01)
*A47F 3/00* (2006.01)
(Continued)

(52) U.S. Cl.
CPC ..... *A47F 11/10* (2013.01); *A47F 3/001* (2013.01); *F21S 4/20* (2016.01); *F21V 7/005* (2013.01);
(Continued)

(58) Field of Classification Search
CPC .. A47F 11/10; A47F 3/001; F21S 4/20; F21V 7/005; F21V 11/00; A47B 2220/0077;
(Continued)

(56) References Cited

U.S. PATENT DOCUMENTS 4,748,543 A 5/1988 Swarens
7,607,794 B1 10/2009 Thompson
(Continued)

FOREIGN PATENT DOCUMENTS

CA 2803000 12/2011
WO 2013034497 3/2013

OTHER PUBLICATIONS

GE Lighting, "Immersion (TM) LED Display Case Lighting", pp. 1-2, 2013 Retrieved from the Internet: [https://www.villalighting.com/ASSET/DOCUMENTS/ITEMS/EN/1157249_spec%20sheet.pdf].
(Continued)

*Primary Examiner* — Tracie Y Green
(74) *Attorney, Agent, or Firm* — Benoit & Cote, Inc.; C. Marc Benoit

(57) ABSTRACT

There is described a lighting device for illuminating a display space comprising a structure mounted about the display space comprising an elongated housing comprising a bottom extremity and a front edge, an opening being defined between the bottom extremity and the front edge, the bottom extremity at a height defining a horizon line and the front edge located above the horizon line; and a light source mounted within the housing entirely above the horizon line and for producing an illumination area bound by and exiting the opening.

19 Claims, 5 Drawing Sheets

(51) Int. Cl.

| | |
|---|---|
| ***F21S 4/20*** | (2016.01) |
| ***F21V 7/00*** | (2006.01) |
| *F21W 131/405* | (2006.01) |
| *F21Y 103/10* | (2016.01) |
| *F21Y 115/10* | (2016.01) |
| *F21V 11/00* | (2015.01) |

(52) U.S. Cl.
CPC ..... *A47B 2220/0077* (2013.01); *F21V 11/00* (2013.01); *F21W 2131/405* (2013.01); *F21Y 2103/10* (2016.08); *F21Y 2115/10* (2016.08)

(58) Field of Classification Search
CPC ..... F21Y 2115/10; F21Y 2103/10; F21W 2131/405
See application file for complete search history.

(56) References Cited

U.S. PATENT DOCUMENTS

| | | | | |
|---|---|---|---|---|
| 8,113,680 | B2 | 2/2012 | O'Brien et al. | |
| 8,506,116 | B2 | 8/2013 | Sloan et al. | |
| 9,435,517 | B2 * | 9/2016 | Gordin | F21S 4/00 |
| 9,726,337 | B2 * | 8/2017 | Hedberg, Jr. | F21S 8/026 |
| 10,161,608 | B2 * | 12/2018 | Pallai | F21V 15/01 |
| 2007/0291480 | A1 | 12/2007 | Sherman | |
| 2008/0285260 | A1 | 11/2008 | Sherman | |
| 2011/0002114 | A1 * | 1/2011 | Koerner | A47F 3/001 362/126 |
| 2018/0113244 | A1 * | 4/2018 | Vasylyev | G02B 6/0036 |

OTHER PUBLICATIONS

Novakovic, Zoran, International Search Report for PCT/CA2017/050377, dated Jun. 27, 2017. PCT/ISA/210. 4 Pages.

* cited by examiner

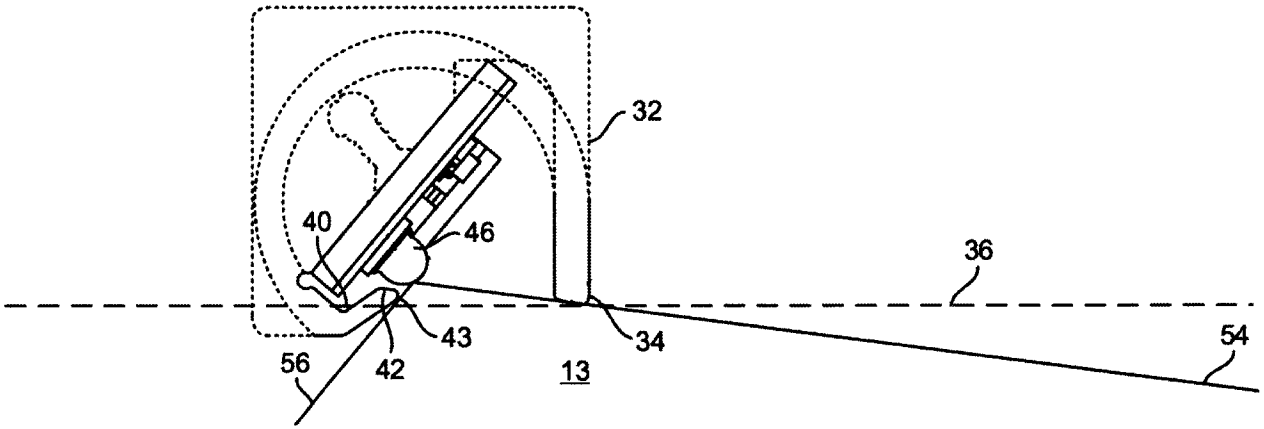
FIG. 4A
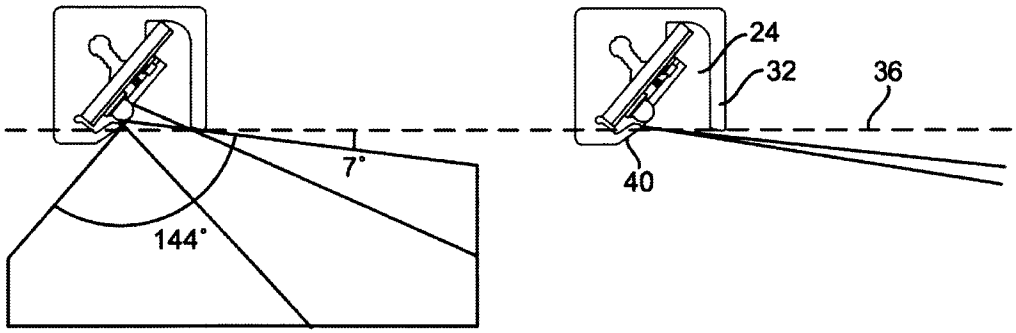
FIG. 4B
FIG. 4C
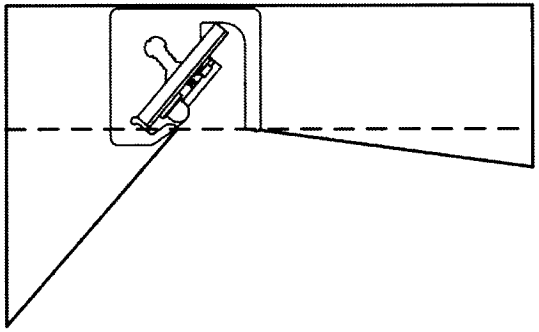
FIG. 4D

HIDDEN LIGHTING FOR A DISPLAY SPACE

CROSS-REFERENCE TO RELATED APPLICATION

This application claims priority from U.S. patent provisional application 62/312,847 filed Mar. 24, 2016, the specification of which is hereby incorporated herein by reference in its entirety.

FIELD OF THE INVENTION

The disclosure generally relates to lighting of display cases or the like.

There is a need for lighting devices which provide illumination of a display space while keeping the light source hidden from the view of a casual observer.

SUMMARY

According to an embodiment, there is provided a light source assembly comprising an elongated housing comprising a bottom extremity and a front edge, an opening being defined between the bottom extremity and the front edge, the bottom extremity at a height defining a horizon line and the front edge located above the horizon line; a light source mounted within the elongated housing entirely above the horizon line and for producing an illumination area bound by opening and toward a display space.

According to an aspect, the light source assembly further comprises an exterior wall from which extends the bottom extremity.

According to an aspect, the light source assembly further comprises a shield wall extending below the light source and from which extends the front edge.

According to an aspect, the exterior wall spans from the bottom extremity to the shield wall around the light source.

According to an aspect, the exterior wall has a curved shape with a constant radius.

According to an aspect, the light source assembly further comprises a reflecting wall extending from the bottom extremity and having a face which reflects light from the light source toward the display space.

According to an aspect, the exterior wall comprises a front wall from which extends the bottom extremity.

According to an aspect, the light source assembly further comprises a back wall opposite the front wall and from which the shield wall extends.

According to an aspect, the light source is mounted within the elongated housing at an angle to produce an illumination area in a front direction being substantially toward the front of the elongated housing.

According to an aspect, an angle of the illumination area forms an angle with the horizon line in the front direction of less than 10°.

According to an aspect, the illumination area spans 144° and makes a 49° angle with the horizon line in a rear direction and a 7° angle with the horizon line in the front direction.

According to an aspect, the front edge is shaped as a lip extending toward the bottom extremity.

According to an aspect, the lip creates a shadow zone toward the rear direction.

According to an aspect, the elongated housing is composed of a single body.

According to an aspect, the elongated housing is made of an opaque material.

According to an embodiment, there is provided a lighting device for illuminating a display space comprising a structure mounted about the display space comprising an elongated housing comprising a bottom extremity and a front edge, an opening being defined between the bottom extremity and the front edge, the bottom extremity at a height defining a horizon line and the front edge located above the horizon line; and a light source mounted within the elongated housing entirely above the horizon line and for producing an illumination area bound by opening.

According to an aspect, the structure further comprises legs secured to the elongated housing thereby defining a self-standing structure.

According to an aspect, the lighting device further comprises an exterior wall from which extends the bottom extremity.

According to an aspect, the lighting device further comprises a shield wall extending below the light source and from which extends the front edge.

According to an aspect, the exterior wall spans from the bottom extremity to the shield wall around the light source.

Where applicable, multiple combinations of the elements of light source assembly described above can be are possible.

In accordance with one aspect, there is provided a lighting device for illuminating a display space, for example the inner space of a display case.

The device includes one or more elongated housings, each provided with a light source assembly. The elongated housing has a recessed chamber extending along a length thereof and a partially opened bottom end. The elongated housing includes a top wall, a back wall and a front wall shorter than the back wall. The front wall has a free bottom extremity at a height defining a horizon line of the device. The elongated housing further includes a bottom wall projecting from the back wall and extending partially along the bottom end. A shield wall projects frontward and upward within the recessed chamber from the extremity of the bottom wall opposite the back wall. The shield wall forms an angle with the bottom wall and has a top extremity above the horizon line. Optionally, the front edge of the shield wall forms a shielding lip.

The light source assembly includes a light source for generating light. The light source is mounted within the chamber and positioned in a lower section of the chamber and slightly above and forward of the top extremity of the shield wall.

Advantageously, the elements of a lighting device according to implementations can be configured to provide an illumination area suitable to illuminate a display space, while effectively hiding the light source from view. Furthermore, discomforting reflections or glares can be prevented from reaching an observer.

Other features and advantages of the invention will be better understood upon a reading of embodiments thereof with reference to the appended drawings.

BRIEF DESCRIPTION OF THE DRAWINGS

Further features and advantages of the present disclosure will become apparent from the following detailed description, taken in combination with the appended drawings, in which:

FIGS. 4A to 4D are schematized cross-sectional views of an elongated housing and corresponding light source assembly, illustrating various aspects of the generated illumination area.

DETAILED DESCRIPTION

In accordance with one aspect, there is provided a lighting device for illuminating a display space.

The display space may for example be embodied by the inner space of a display case, a shelf, or any other space in which one or more objects is presented for observation to observers. Implementations of the disclosed lighting device may be of particular interest for use in contexts in which objects are to be illuminated without the source of light being readily apparent or bothersome to the observers. Examples of such applications include the retail industry, for example to display luxury items such as jewelry, handbags, etc. It will be readily understood that the present lighting device may also be of use in other contexts, such as museums and other expositions, etc.

Figure 1:
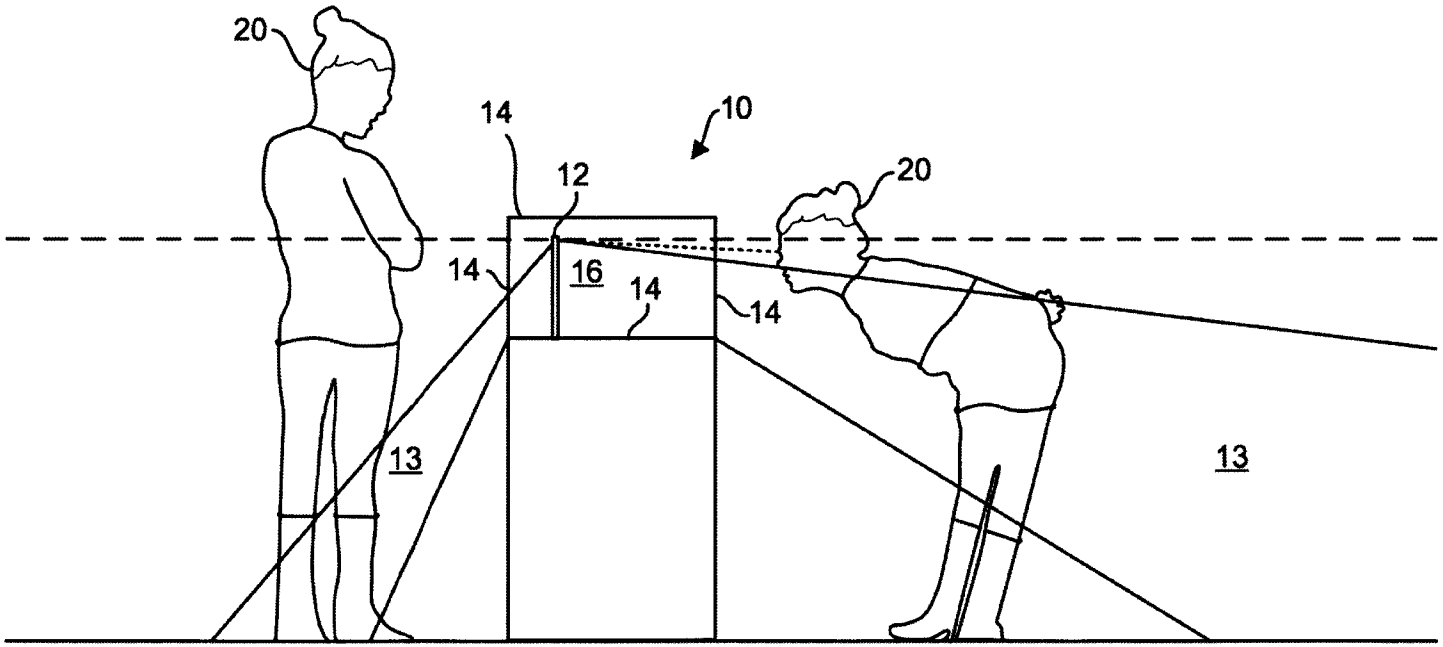
FIG. 1 is a schematized representation of a display case provided with a lighting device according to an embodiment.

Referring to FIG. 1, there is shown an example of a display case 10 illuminated by a lighting device 12 according to an embodiment of the invention. The display case 10 may be a closed structure having at least some of its walls 14 made of glass or other transparent material. In the illustrated example, the display case 10 is shown as a rectangular structure, although it will be readily understood that other shapes may be envisioned as well. The inner space of the display case defines a display space 16, in which objects can be presented for view by the observers 20.

The lighting device 12 is mounted so that it projects an illumination area 13 encompassing the display space 16. As illustrated, the illumination area 13 has orientations preventing the observers 20 from having a direct view of the lighting device 12 in normal conditions.

Figure 2:
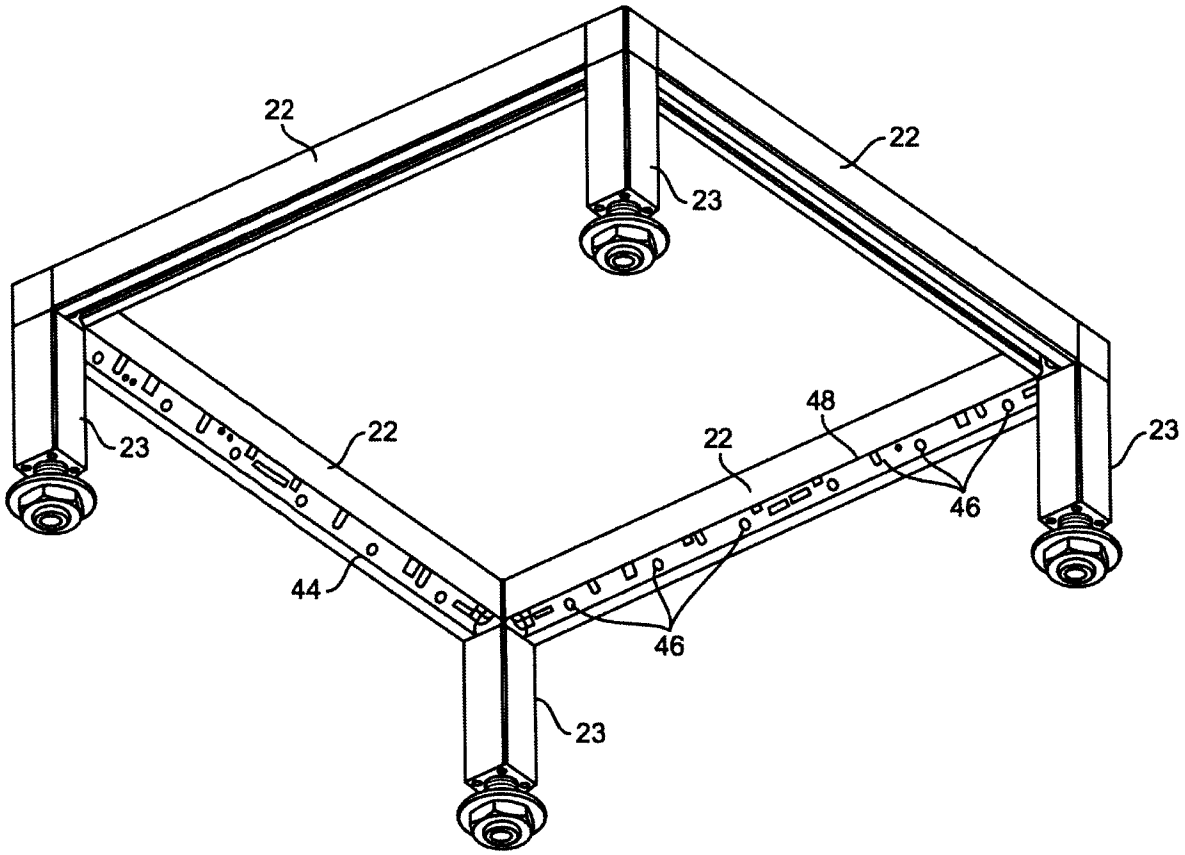
FIG. 2 is a bottom elevation view of a lighting device according to an embodiment.

Referring additionally to FIG. 2, is some implementations the lighting device 12 may include one or more elongated housing 22, in each of which is mounted a corresponding light source assembly 44 generating light. Although four housings 22 are shown in a rectangular configuration in FIG. 2, in other variants a single housing 22 or a different number of such housings 22 in any desired configuration may be provided without departing from the intended scope of the present disclosure. It will be readily understood that when multiple elongated housings 22 and corresponding light source assemblies 44 are present, the overall illumination of the display space 16 will be a combination of the individual illumination area 13 of each light source assembly 44.

Each elongated housing 22 of the light source assembly 44 may be installed in relation to the display space 16 in any suitable manner according to the desired illumination pattern. As seen in FIG. 2, in some embodiments, the elongated housings 22 may be mounted on support legs 23 which can be bolted on a support surface, such as the bottom surface of a display case, such as illustrated in FIG. 1. In other variants, the elongated housings 22 could be mounted in a different manner, for example suspended from a surrounding structure.

It will be readily understood that the elongated housings 22 and the support legs 23 may be secured to define a single structure 25 as illustrated on FIG. 2. It will also be readily understood that the number of components of the structure 25, the elements used to secure the components of the structure 25 together to define releasable attachments and/or permanent attachments, and the additional elements involved in securing additional components such as the glass walls 14 for example may vary based on functional parameters such as desired robustness and aesthetic parameters such as invisible wall attachments. Examples of such securing elements and associated technics comprise welding, bolting, riveting, joining through complementary concave and convex shapes, clipping, use of clips, magnetic attachments, and a combination of such securing elements and technics.

Back to the illumination of the display space 16, it is known in the art that aesthetically pleasing illumination involves several considerations. According to an embodiment, the illumination area 13 generated by the light source assemblies 44 used for this purpose should be perceived as even by an observer 20, and have an extent that matches as closely as possible the inner space of the display case 10 with minimal spills towards the outside. Reflections on structural elements or exterior components are typically to be avoided or minimized.

In order to properly illuminate the entire volume of the display space 16, the illumination area 13. According to an embodiment extends as close as possible to the horizontal in the front direction, so that the top portion of the display case 10 also receives some of the light. One way to achieve this type of illumination is by leaving the space in front of the light source assemblies 44 unencumbered, for example by shortening the front wall of the elongated housing 22. However, it is also preferable for the overall aesthetic value of the display arrangement that the light source assemblies 44 themselves and their components be as visually discreet as possible. In particular, components conceived as optical and electronic elements, such as wires, circuits, light emitting components, etc., are generally considered unsightly and should be hidden from view by the observer 20. Furthermore, the light reaching the observers 20 is, according to an embodiment glare-free to prevent visual discomfort of the observers 20. One particular challenge is therefore to hide the light source assembly 44, that is, the element generating the illumination area 13 illuminating the display space 16. In order for the illumination area 13 to provide suitable illumination of the entire volume of the display space 16, the light source assembly 44 must inherently be positioned such that its field of view of the observer 20 encompasses the display space 16, making it difficult to hide it away from the line sight of the observer 20.

Figure 3:
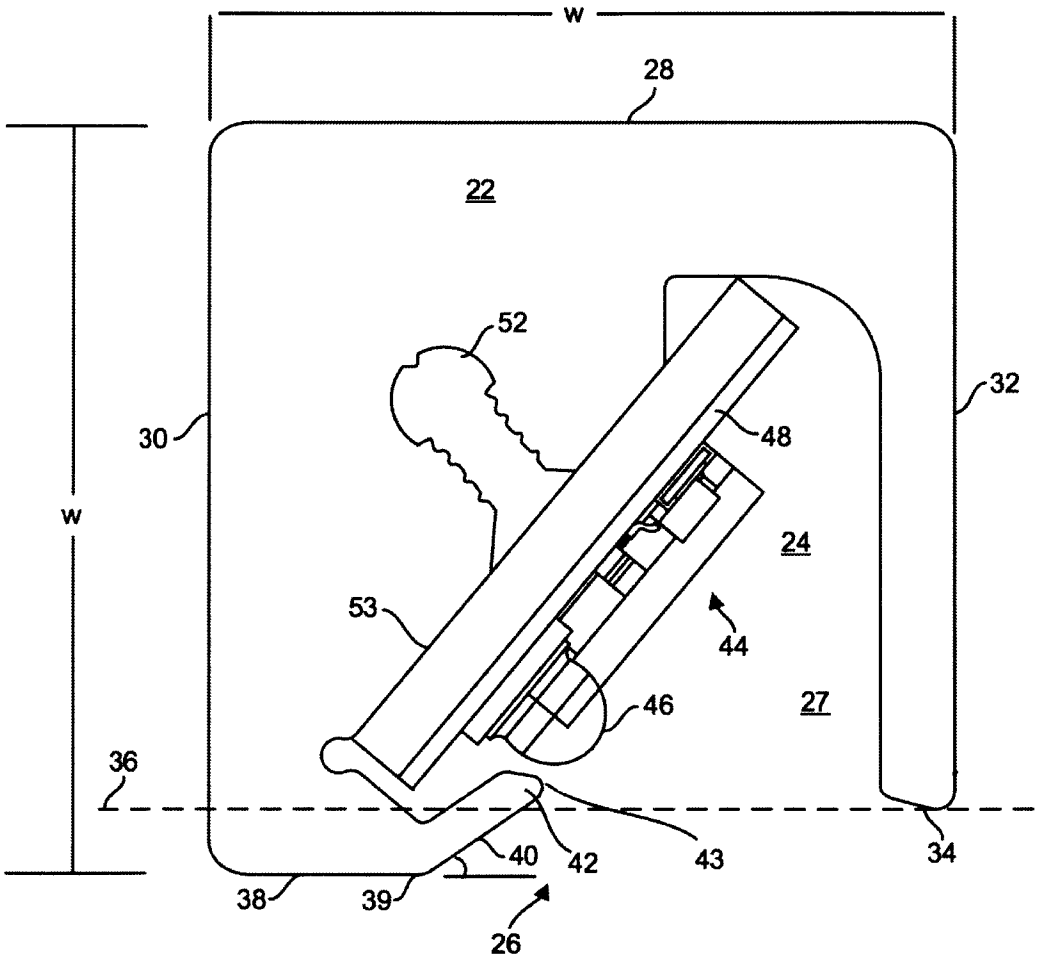
FIG. 3 is a schematized cross-sectional view of an elongated housing and corresponding light source assembly according to one embodiment.

Referring additionally to FIG. 3, shows a cross-section view of a lighting device 12 according to one aspect that can address this challenge.

The lighting device 12 includes an elongated housing 22, as mentioned above. It will be readily understood that multiple elongated housings 22 of similar configuration may be provided without departing from the intended scope of the present disclosure. The elongated housing 22 has a recessed chamber 24 extending along its length. In some implementations, the elongated housing 22 is made from a metallic rod extruded to form the recessed chamber 24 therein. As can be seen in FIG. 3, the recessed chamber 24 has a partially opened bottom end 26 with the recessed chamber forming a groove 27 in the longitudinal direction of the elongated housing 22. The recessed chamber 24 faces at least partially toward the display space 16.

The elongated housing 22 is shaped to define a top wall 28, a back wall 30 and a front wall 32 in a general U-shape configuration. In the illustrated embodiment, the top wall 28 and the back wall 30 have a same width (w) and are perpendicular to each other. The front wall 32 is parallel to the back wall 30. Thus, the overall cross-sectional area of the elongated housing 22 is a square.

The elongated housing 22 further includes a bottom wall 38 projecting from the back wall 30 and extending partially along the bottom end 26 of the elongated housing 22. In the illustrated embodiment, the bottom wall 38 extends parallel to the top wall 28 about a quarter of the way across the bottom end 26, although this proportion is shown by way of example only.

The front wall 32 is shorter than the back wall 30, thus has a free bottom extremity 34 higher than the bottom wall 38. A horizon line 36 is defined by the bottom extremity 34 of the front wall 32, which by definition extends horizontally in the reference frame of the observer 20.

The elongated housing 22 further includes a shield wall 40 projecting frontward and upward toward the recessed chamber 24 from the extremity 39 of the bottom wall 38 opposite the back wall 30. The shield wall 40 has an angle A relative to the bottom wall 38. The shield wall 40 comprises a top extremity 42 above the horizon line 36. The function of the shield wall 40 will be explained further below.

The front edge 43 of the shield wall 40 and the bottom extremity 34 of the front wall 32 define an opening 62 bounding light emitted by the light source 46 as will be explained further below.

The lighting device 12 further includes a light source assembly 44 including one or more light sources 46 for emitting light. Referring to both FIG. 2 and FIG. 3, in the illustrated embodiment the light sources 46 are embodied by a plurality of individual Light Emitting Diodes (LEDs) 47 distributed along the length of the elongated housing 22. It will be readily understood that the intensity, color, number, distribution and other characteristics of the LEDs 47 are design consideration well known to those skilled in the art and that distinct decision regarding these characteristics may be made by one skilled in the art without departing from the intended scope of the present disclosure.

Still in the illustrated embodiment of FIGS. 2 and 3, the light source assembly 44 includes a Printed Circuit Board (PCB) 48 on which the LEDs 47 are mounted, along with electronic components associated with their control. The LEDS 47 are mounted offset in the recessed chamber 24 to the shield wall 40. The PCB 48 is secured to the elongated housing inside the recessed chamber 24. In the illustrated embodiment, the PCB 48 is secured to the inside of recessed chamber 24 by screws 52 or other fasteners. It will be readily understood that the mechanical mounting of the light sources 46 in the elongated housing 22 may be provided in a variety of different manners without departing from the intended scope of the present disclosure.

The recessed chamber 24 further comprises a floor 53 to which the PCB 48 is mounted. According to an embodiment, the floor 53 is facing at least partially the display space 16, thereby allowing a substantially flat PCB 48 to have the desired configuration of having the height of the LED 47 in the recessed chamber 24 varying based on the offset mounting configuration.

Still referring to FIG. 3 and with additional reference to FIG. 4A to 4D, the relative positioning of the LED 47, horizon line 36 and shield wall 40 will now be described in more details.

In accordance with one aspect, the LEDs 47 or other light source 46 is positioned within a lower section of the chamber 24, slightly above and forward of the top extremity of the shield wall 40 and therefore fully above the horizon line 36. According to an embodiment, the LEDs 47 of a given light source assembly 44 are mounted on the PCB 48 offset from the longitudinal axis of symmetry of the PCB 48, such that the LEDs 47 can be positioned closer to the horizon line 36.

Referring to FIG. 4A, the maximal extend of the illumination area 13 projected by the LED 47 (the light source 46) is schematically illustrated. The illumination area 13 is bound in the front direction by a front light ray 54 and in the rear direction by a rear light ray 56. The front light ray 54 corresponds to the straight line joining the lowermost light emitting point 58 on the LED 47 and the obstructing portion of the bottom extremity 34 of the front wall 32 preventing a straight line to be drawn higher. According to an embodiment, the bottom extremity 34 is angled such that reflections thereon are not directed above the horizon line 36 and towards an observer 20. According to one embodiment, the front light ray 54 is slightly downwardly angled, thereby preventing the observer 20 to view the light source 46. According to an embodiment, the bottom extremity 34 comprises a face 41 that is generally parallel to the front light ray 54 or forms a steeper angle with respect to the vertical than the front light ray 54. The rear light ray 56 corresponds to the straight line joining the frontmost light emitting point 60 on the LED 47 and the front edge 43 of the shield wall 40 at its top extremity 42. It will be readily understood that the representation of FIG. 4A does not take into account diffraction effects which can alter slightly the orientation of the front and rear light rays 54 and 56.

The angle of the shield wall 40 and relative positioning of its front edge 43 and of the frontmost light emitting point 60 on the LED 47 are jointly selected so that the side of the shield wall 40 extends non-obstructively with respect to the illumination area 13, ensuring that there will be no light reflection on the side of the shield wall 40. In the illustrated embodiment, the front edge 43 of the shield wall 40 is shaped as a forward projecting lip, creating a shadow zone underneath, avoiding surface illumination of the shield wall 40, as best seen in FIG. 4D. The provision of the projecting lip can enable the use of a smaller inclination in the shield wall 40. As seen in FIG. 2, the projecting lip can be omitted in some embodiments without departing from the intended scope of the present disclosure.

In the illustrated embodiments, the LED 47 and the shield wall 40 are designed so that the rear light ray 56 projects backwardly, providing illumination in the rearward direction. Such a configuration could for example provide an illumination area 13 spilling out of the bottom of the display case, such as shown in FIG. 1. It will however be readily understood that by moving the position of the light source 46 (LED 47), of the front edge 43 of the shield wall 40, or both, the orientation of the rear light ray 54, and therefore the extent of the illumination area 13, can be selected according to a desired design. As shown in FIG. 4B, the particular configuration illustrated therein provides an illumination area 13 spanning 144° and making a 49° angle with the horizon lines in the rear direction and a 7° angle with the horizon line in the front direction. These values are however provided by way of example only and should in no way be considered limitative to the intended scope of the present disclosure. In another embodiment, the illumination area 13 spans more than 130°. In another embodiment, the illumination area 13 spans more than 120°. In another embodiment, the illumination area 13 spans more than 110°. In another embodiment, the angle with the horizon line in the front direction is less than 15°. In another embodiment, the angle with the horizon line in the front direction is less than 10°. In another embodiment, the angle with the horizon line in the front direction is less than 7°.

The top extremity 42 of the shield wall 40 is positioned and angled to avoid any stray light reflection to project above the horizon line 36. As shown in FIG. 4C, reflections of front and rear light rays 54 and 56 on the top of the shield wall 40 will only escape the chamber 24 if they project below the horizon line 36; any such reflections directed above the horizon line 36 will be blocked by the front wall 32 and either absorbed within the chamber 24 or reflected downwardly.

Figure 5:
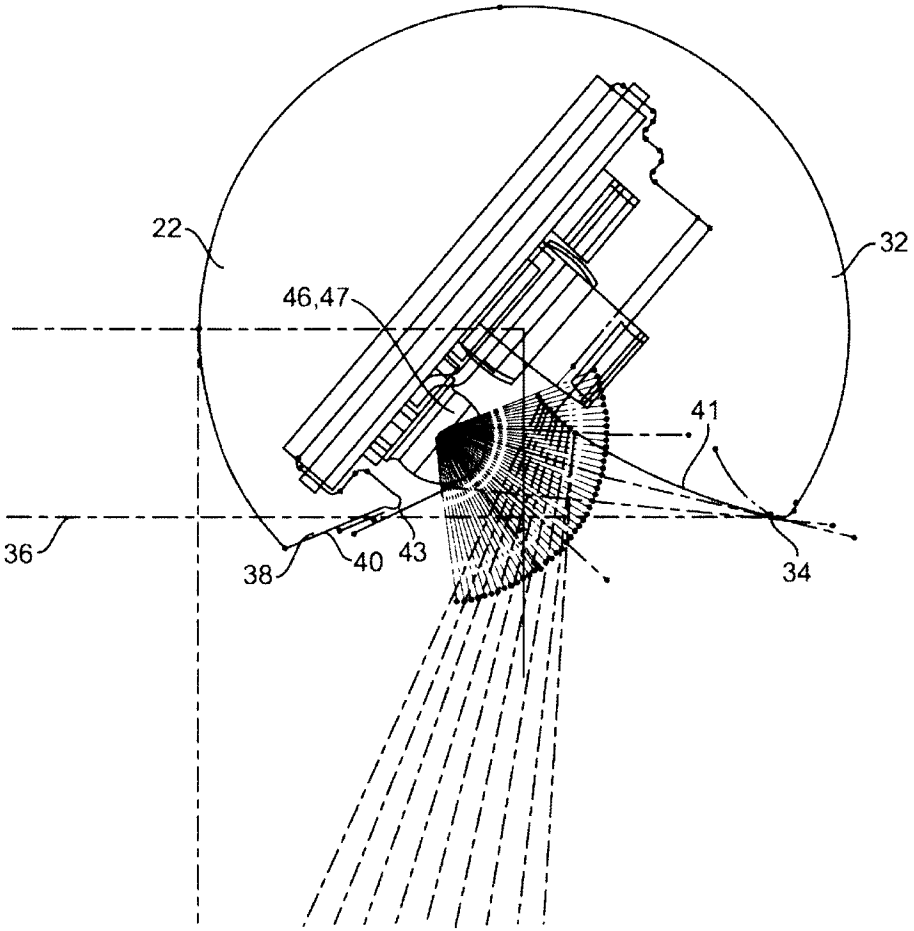
FIG. 5 is a schematized cross-sectional view of an elongated housing and corresponding light source assembly according to another embodiment.

Referring to FIG. 5, a cross-section of another embodiment of the lighting device 12 still comprises an elongated housing 22 installed in the similar fashion as the one illustrated on FIG. 2. The lighting device 12 of FIG. 5 features similar components, namely a light source 46 consisting as a LED 47 enclosed in a recessed chamber 24 of the elongated housing 22, the recessed chamber 24 being defined between a bottom wall 38 having a front edge 43, and a front wall 32 having a bottom extremity 34 defining a horizon line 36. The front edge 43 of the bottom wall 38 is located above the horizon line 36, with the LED 47 being located above the front edge 43. The face 41 is configured as an arched surface on which light emitted by the LED 47 reflects and adds up to the non-reflected light composing the illuminating area 13. Such alternative embodiment features benefits of providing a uniform illumination area 13 while exploiting most illumination potential of the LED 47. The illustrated embodiment further features values that provided examples of dimension and angle ratios.

As will be readily understood by one skilled in the art, according to another implementation the light source further 46 comprises a diffuser film disposed in front of the LEDs 47. The LEDs 47 and the diffuser film, by its nature and configuration, direct and control the emitted illumination area. The elongated housing 22 further comprises a housing configuration, abutment or other structural or fastening components adapted to house and maintain the driver the diffuser film in place and in the desired orientation within the elongated housing 22.

As will be readily understood by one skilled in the art, according to another implementation the above-discussed diffuser film is replaced by nano-optic film (such as developed by Microsharp Corporation Limited as available at http://www.microsharp.co.uk/) disposed in front or over the surface of the LEDs 47. The nano-optic film comprises shapes to reflect and direct the light emitted by the LEDs 47 in a controlled light spreading angle. The nano-optic film may further partially control the intensity of light transmitted in particular sub-portions of the spreading angles.

As will be readily understood by one skilled in the art, according to another implementation the elongated housing 22 may be composed of many materials, alone or in combination, that may be configured to provide the desired configuration and physical characteristics allowing the elongated housing 22 to house the light source 46 as to resist to the heat emitted by the light source 46. Examples of such materials include, heat-resistant plastic, heat-resistant rubber, steal and other metallic materials, etc.

As will be readily understood by one skilled in the art, the implementations described above provide an illumination area 13 suitable to illuminate a display space, while effectively hiding the light source 46 from view. Indeed, an observer 20 would need to position his eyes somewhere below the horizon line 36 to be able to see the LEDs 47. The illustrated configuration also prevents discomforting reflections or glares from reaching an observer 20.

As will be further readily understood by one skilled in the art, the above description has been performed in relation with the lighting device 12 comprising a single elongated housing 22. However, as illustrated on FIG. 2, the lighting device 12 may comprise a number of elongated housings (four illustrated on FIG. 2). Further, location of the elongated housings 22, their configuration and their location may vary between realizations. Selection of the appropriate characteristics are questions of aesthetic considerations in relation with contextual considerations such as the installation environment. Accordingly, other embodiments may also be conceived wherein, for example, boundary light rays may be desired to be directed toward a vertical wall, a ceiling, etc. without departing from the intended scope of the present disclosure.

Furthermore, it is without mentioning that even if no mention of the power source feeding the light source 46 has been discussed in relation with embodiments, many known power sources may provide power necessary for the operation of the lighting device 12. Additional components may further be present between the power source and the light source 46, such as a switch, a dimmer, electric cables, circuit breaks, etc. for proper operation of the lighting device 12.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A light source assembly comprising:

an elongated housing comprising a bottom extremity and a front edge, an opening being defined between the bottom extremity and the front edge, the bottom extremity at a height defining a horizon line and the front edge defining a vertical line;

a light source mounted within the elongated housing entirely above the horizon line and at least partially past the vertical line for producing an illumination area bound by the opening and toward a display space, wherein the illumination area comprises direct lighting on both sides of the vertical line below the front edge.

2. The light source assembly of claim 1, wherein the housing further comprises an exterior wall from which extends the bottom extremity.

3. The light source assembly of claim 2, wherein the housing further comprises a shield wall extending below the light source and from which extends the front edge.

4. The light source assembly of claim 3, wherein the exterior wall spans from the bottom extremity to the shield wall around the light source.

5. The light source assembly of claim 4, wherein the exterior wall has a curved shape with a constant radius.

6. The light source assembly of claim 2, further comprising a reflecting wall extending from the bottom extremity and having a face which reflects light from the light source toward the display space.

7. The light source assembly of claim 2, wherein the exterior wall comprises a front wall from which extends the bottom extremity.

8. The light source assembly of claim 7, further comprising a back wall opposite the front wall and from which the shield wall extends.

9. The light source assembly of claim 1, wherein the light source is mounted within the elongated housing at an angle to produce an illumination area in a front direction being substantially toward the front of the elongated housing.

10. The lighting source assembly of claim 9, wherein an angle of the illumination area forms an angle with the horizon line in the front direction of less than 10°.

11. The light source assembly of claim 10, wherein the illumination area spans 144° and makes a 49° angle with the horizon line in a rear direction and a 7° angle with the horizon line in the front direction.

12. The light source assembly of claim 1, wherein the lip creates a shadow zone toward the rear direction.

13. The light source assembly of claim 1, wherein the elongated housing is composed of a single body.

14. The light source assembly of claim 1, wherein the elongated housing is made of an opaque material.

15. A lighting device for illuminating a display space comprising:

a structure mounted about the display space comprising an elongated housing comprising a bottom extremity and a front edge, an opening being defined between the bottom extremity and the front edge defining a vertical line, the bottom extremity at a height defining a horizon line; and a light source mounted within the elongated housing entirely above the horizon line and at least partially past the vertical line for producing an illumination area bound by opening, wherein the illumination area comprises direct lighting on both sides of the vertical line below the front edge.

16. The lighting device of claim 15, wherein the structure further comprises legs secured to the elongated housing thereby defining a self-standing structure.

17. The lighting device of claim 15, wherein the housing further comprises an exterior wall from which extends the bottom extremity.

18. The lighting device of claim 17, wherein the housing further comprises a shield wall extending below the light source and from which extends the front edge.

19. The lighting device of claim 18, wherein the exterior wall spans from the bottom extremity to the shield wall around the light source.

* * * * *